US008469702B2

(12) United States Patent
Muff et al.

(10) Patent No.: US 8,469,702 B2
(45) Date of Patent: Jun. 25, 2013

(54) FIRE AND WATER DISPLAY WITH INTEGRATED SAFETY FEATURES

(76) Inventors: William H. Muff, Wheat Ridge, CO (US); Timothy C. Muff, Arvada, CO (US)

( * ) Notice: Subject to any disclaimer, the term of this patent is extended or adjusted under 35 U.S.C. 154(b) by 507 days.

(21) Appl. No.: 12/788,230

(22) Filed: May 26, 2010

(65) Prior Publication Data

US 2010/0304318 A1 Dec. 2, 2010

Related U.S. Application Data

(60) Provisional application No. 61/181,611, filed on May 27, 2009.

(51) Int. Cl.
*F23D 14/46* (2006.01)

(52) U.S. Cl.
USPC ..... 431/350; 431/22; 431/23; 431/24; 431/66; 431/69

(58) Field of Classification Search
USPC ..... 431/350, 202, 125, 126, 253, 278, 431/8; 126/512, 500, 519; 239/18; 362/96
See application file for complete search history.

(56) References Cited

U.S. PATENT DOCUMENTS 3,038,064 A * 6/1962 Gieb ..... 431/125
3,830,217 A * 8/1974 Maness et al. ..... 126/513
4,858,826 A 8/1989 Robinson et al.
5,092,312 A 3/1992 Zolow
5,961,042 A 10/1999 Doyle
6,131,819 A 10/2000 Fuller et al.
6,871,793 B2 3/2005 Rumens et al.
6,901,925 B2 6/2005 Coughlin
7,628,608 B1 12/2009 Doyle et al.
2005/0196715 A1 * 9/2005 Shumway ..... 431/11

OTHER PUBLICATIONS

"Fire Fountains—6" Manifold Kit," Living Water Aeration website at http://www.livingwateraeration.com/fifo6makit.html, accessed Oct. 8, 2010, 2 pages.
AquaticGlassel.com® website at http://www.aquaticglassel.com, copyright 2005, 18 pages.
Flame Creation website at http://www.gaslight-firepit.com/firewater-c-71-html, copyright 2010, 2 pages.

* cited by examiner

*Primary Examiner* — Alfred Basichas
(74) *Attorney, Agent, or Firm* — Sheridan Ross P.C.

(57) ABSTRACT

A system for providing a combined water and fire display is provided. More specifically, a decorative display comprises a dynamic water and fire display device where fuel/air, water, and fire are integrated. The decorative display provides for unique aesthetic qualities and an appearance wherein flames are positioned at or near the surface of a volume of water. In various embodiments, the decorative display further comprises various safety features including the ability to detect and self-regulate conditions such as the existence and/or absence of a pilot flame, an adequate amount of water, and the temperature of various portions of the system. The decorative display further contemplates the ability to operate without one or more disclosed features, such as when only a water display or only a fire display is desired.

19 Claims, 7 Drawing Sheets

FIRE AND WATER DISPLAY WITH INTEGRATED SAFETY FEATURES

CROSS-REFERENCE TO RELATED APPLICATIONS

The present application claims priority to U.S. Provisional Patent Application 61/181,611, filed May 27, 2009, the entire disclosure of which is hereby incorporated by reference in its entirety for all that it teaches.

FIELD OF THE INVENTION

The field of the present disclosure is directed to decorative displays. More particualry, the present disclosure is directed to water or fire displays.

BACKGROUND OF THE INVENTION

Homeowners often desire ornamental displays be placed in their yards. The displays can be birdbaths, fountains, waterfalls, fireplaces, etc. Sometimes elements of the displays are combined. For example, U.S. Pat. No. 5,092,312 to Zolow (hereinafter "Zolow"), which is incorporated herein by reference in its entirety, describes a fireplace structure with a water fountain in the front part of a fire box. While Zolow provides an ornamental display that includes fire and water features, Zolow isolates the water feature from the fire feature. Zolow arranges the water feature and the flame/gas flow in two distinct locations and uses different supplies and instrumentation to control the separate features.

Similarly, U.S. Pat. No. 6,871,793 to Rumens et al. (hereinafter "Rumens"), which is incorporated herein by reference in its entirety, discloses an ornamental display that includes an interaction between water and fire. However, Rumens describes isolates the fire and water effects using devices, such as, water shields.

U.S. Pat. No. 5,961,042 to Doyle (hereinafter "Doyle"), which is incorporated herein by reference in its entirety, describes a water and fire display apparatus characterized by a burning fuel/air mixture entrained in a stream of water. Doyle describes self-entraining nozzles disposed in a pool that spray a stream of water. The self-entraining nozzles also include a gas injection line, in the base of a Venturi, that entrains gas, air, and water in a single stream of water.

U.S. Pat. No. 4,858,826 to Robinson et al. (hereinafter "Robinson"), which is incorporated herein by reference in its entirety, describes a colored flame system for illuminating water fountains. Robinson describes a system whereby the color of flames incorporated into a water display may be altered through the addition of concentrated solutions of metallic salts.

These decorative displays fail to provide a water and fire display, which provides for interaction between a still water body and source gas(es) to be combusted into flame(s). Certainly, the current displays fail to describe appropriate safety control features which decreases the risk of injury to users, bystanders, observers, etc., as well as minimize the amount of maintenance and attention the decorative display.

SUMMARY OF THE INVENTION

Embodiments presented herein include decorative fire and water displays. The decorative display may be employed in indoor and outdoor applications, home use, backyards, lobbies, resorts, hotels, office buildings, cruise ships, stadiums, etc. In embodiments, the decorative fire and water display comprises a combination fire and water display device that may comprise at least one of the following, but is not limited to, a bowl, a basin, a tub, or a reservoir capable of receiving and maintaining a volume of water. The body of water contained within the bowl is generally stagnant. In alternative embodiments, the water is circulated with one or more circulation means. One example of recirculation means suitable for use with the present is the 670 GPH Little Giant® dual purpose pump having model number 3E-34N. One of ordinary skill in the art will recognize that a variety of other recirculation means are within the scope and spirit of the decorative display. The circulation may include streams, falls, or similar pressure/gravity assisted means in order to create a certain level of disruption and aeration in the body of water that aids in the combustion of gases and helps slow the heating of the water.

In embodiments, the decorative display includes a body of standing water through which flammable or combustible gases are transmitted and ignited upon surfacing and/or escaping from the body of water. By way of example only, the combustible gases the decorative display may comprise one or more of, but are not limited to, propane, natural gas, butane, acetylene, cyclopropane, ethane, ethylene, ethyl chloride, isobutan, methane, methyl chloride, propylene, hydrogen and silane. Gas may be supplied to a basal portion of a bowl or basin containing a volume of water through connection means, such as, one or more of the following, but not limited to, stainless steel tubing, PVC tubing, rubber hoses, flex lines, aluminum tubing, copper tubing, and other suitable connections. The gas can rise or float from the connection means to the surface of the water due to the discrepancy between the densities of the water and the gas. Means for igniting gas may include, but are not limited to, a pilot light disposed at a distance above the water level can ignite the flammable gases. The ignited gas can create intermittent and dynamic flames at or above the surface of the water. In embodiments, the provision of gas through the body of water creates a generally random array of flames, which provides creates an appearance that the water is afire.

In embodiments, the decorative display comprises a water and fire display system that includes various safety features to maintain a proper level/volume of water, to detect the presence and/or absence of a pilot light flame, to shut-off of the main gas valve(s) based on certain predetermined conditions, and to sense various conditions, including one or more of, but not limited to, water level, water temperature, gas flow, etc.

The decorative display can also comprise a pilot safety valve with a pilot light sensor. The pilot light sensor/safety valve combination can detect the presence/absence of the pilot light flame and terminate a main supply of gas when a pilot light flame is not detected (e.g. when the pilot has been extinguished by wind, precipitation, etc.). It will be recognized that where a pilot light flame has been extinguished and gas is continuously supplied to the unit, dangerous conditions may be enabled by the buildup of flammable gas at or near the surface of a volume of water. More specifically, it is known that propane, for example, will rise through water due to propane's lower density with respect to water. Upon reaching the surface, however, propane will generally reside and/or accumulate at or near the surface of water due to the fact that propane generally has a higher density than ambient air. Such accumulation of flammable gas poses clear safety concerns and the risk of such accumulation is eliminated or greatly reduced through the use of various features as shown and described herein.

In embodiments, the decorative display also comprises means for sensing the amount or volume of water within the bowl or water retaining portion of the device. For example, water level sensing means may comprise a sensor capable of detecting when a water level falls below a predetermined height, thus requiring termination of gas flow and/or the addition of more water. Advancements and improvements of the decorative display include the transmission of flammable gases through water and subsequent ignition of the gases upon escape from the water due in part to the proximity of a pilot light flame of the decorative display. As water disposed within bowls, reservoirs, etc. of the decorative display is subject to heat (i.e. through flames provided by aspects of the decorative display and/or environmental conditions), water will evaporate and the distance between escaped gases to be ignited and the pilot light will gradually increase. Optimal water levels as described herein are desired in order to ensure proper combustion of gases for both aesthetic and safety purposes. Should the water level be allowed to sink or decrease to undesired levels, dangerous gas build-up may occur at the water line. Thus, the decorative display contemplates means such as water sensors which are further capable of communicating with various other parts of the system, such as a main gas supply, and sending appropriate commands (e.g. a command to cease) such as terminating gas supply, when necessary.

In embodiments, the decorative display comprises auto-fill means which operate to maintain a substantially constant water volume/level. Such auto-fill means may be provided in addition to or in lieu of water-level sensing means as shown and described herein. For example, a known float valve may be implemented which is adapted to trigger water flow upon a water level (i.e. within a main basin or auxiliary reservoir) receding below a predetermined value. The float valve may similarly discontinue additional water flow once a proper water level has been restored.

In yet another embodiment, the decorative display comprises one or more water temperature sensors, such as thermocouples, which are capable of detecting the temperature of the water and communicating with other system components. For example, if water contained within the decorative display exceeds acceptable levels, the water temperature sensors will signal the main gas supply to shut-off, thus allowing the system to cool prior to manual or automatic restart of the system. One or more temperature sensors of the decorative display may be disposed at various locations and depths within the decorative display. In embodiments, a plurality of temperature sensors is disposed within the decorative display, wherein an average (e.g. a mean) of the water temperature is computed from temperature readings taken at various locations within the volume of water. This average may be compared with a predetermined value in order to determine whether actions, such as termination of the main gas supply, need to be taken. In embodiments, as few as one temperature readings are taken by the system in order to determine various actions, such as the termination or commencement of gas flow to the system.

In embodiments, the decorative display comprises a unit that is generally portable (i.e. can be relocated or repositioned without undue expense or burden). Thus, for example, an owner or user may remove and transport the unit in the event that the owner moves or relocates. In an alternative embodiment, the decorative display is designed to be a generally permanent fixture that is adapted for connecting semi-permanent gas-feed lines and/or plumbing to the unit as well as mounting or securing the unit to a structure, base, or foundation.

These and other advantages will be apparent from the disclosure of the embodiments contained herein.

The above-described embodiments, objectives, and configurations are neither complete nor exhaustive. As will be appreciated, other embodiments are possible using, alone or in combination, one or more of the features set forth above or described in detail below. Further, this summary is neither intended nor should it be construed as being representative of the full extent and scope of possible embodiments. The embodiments are set forth in various levels of detail in the summary, in the attached drawings, and in the detailed description. No limitation as to the scope of embodiments is intended to either the inclusion or non-inclusion of elements, components, etc. in this summary. Additional aspects of embodiments will become more readily apparent from the detailed description, particularly when taken together with the drawings.

BRIEF DESCRIPTION OF THE DRAWINGS

The accompanying drawings, which are incorporated in and constitute part of the specification, illustrate embodiments and together with the general description given above and the detailed description of the drawings given below, serve to explain the principle of some of the possible embodiments.

Figure 1:
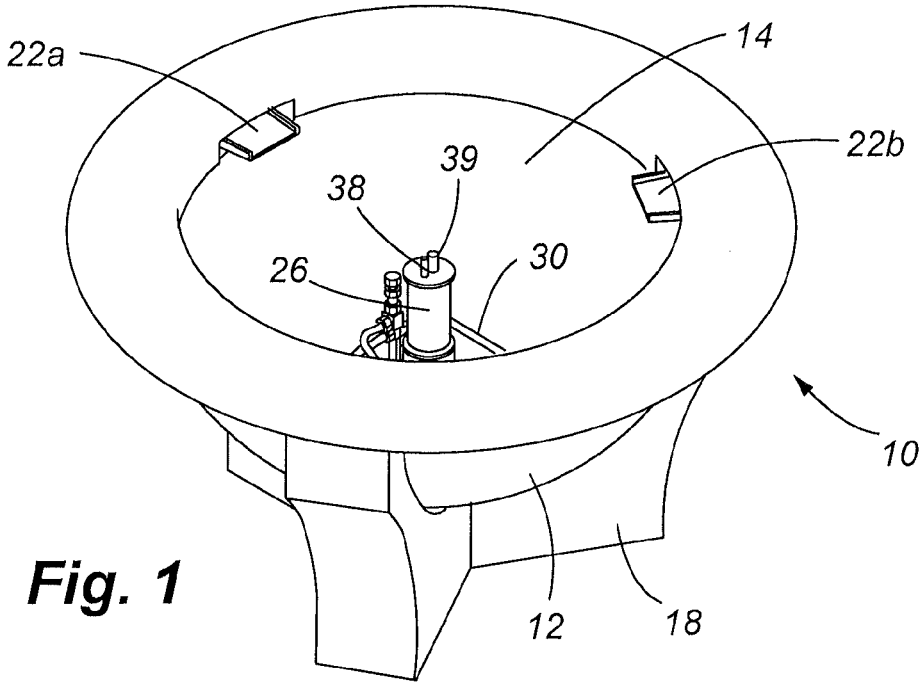
FIG. 1 is a perspective view of one embodiment of the decorative display.

To assist in the understanding of one embodiment of the decorative display, the following list of components and associated numbering found in the drawings is provided:

| | |
|---|---|
| 10 | Water/Fire Display System |
| 12 | Basin |
| 14 | Basin Internal Volume |
| 18 | Basin Support |
| 22a | Weir 1 |
| 22b | Weir 2 |
| 22c | Weir 3 |
| 26 | Combined Water/Fire Unit |
| 30 | Main Gas Conduit |
| 31 | Tube-in-tube/Coaxial tube Arrangement |
| 34 | Pilot Light |
| 38 | Pilot Thermocouple |
| 42 | Water Level |
| 46 | Flame |
| 50 | Drain Line |
| 54 | Flammable Gas |
| 58 | Overflow Drain |
| 62 | Water Level Sensor 1 |
| 64 | Recirculation Drain |
| 66 | Main Drain |
| 70 | Main Power Supply |
| 74 | Main Gas Supply |
| 78 | Main Water Supply |

-continued

| | |
|---|---|
| 82 | Interlock Control Board 1/Interlock Electronics |
| 86a | Weir Hand Valve 1 |
| 86b | Weir Hand Valve 2 |
| 86c | Weir Hand Valve 3 |
| 90 | Recirculation Pump |
| 94 | Gas Valve 1 |
| 98 | Thermocouple Junction Board/Block1 |
| 102 | Float Valve |
| 106 | Water Supply Hand Valve |
| 110 | Water Drain Valve |
| 114 | Water Temperature Sensor 1 |
| 115 | Flange |
| 116 | Pilot Light Gas Flow |
| 118 | Main Gas Flow |
| 122 | Recirculation Water Flow |
| 126 | Multi-Function Conduit |
| 130 | Thermocouple Wiring |
| 150 | Inner Tube |
| 154 | Outer Tube |
| 156 | Low Water Limit |
| 158 | High Water Limit |
| 166 | Gas Release Channel |
| 170 | Gas Redirect Channel |
| 172 | Thermocouple electronics |
| 174 | Water temperature electronics |
| 176 | Water level control electronics |
| 178 | Interlock electronics |
| 180 | Voltage divider network |
| 182 | Water level transistor |
| 184 | Comparator A |
| 186 | Comparator B |
| 188 | NOR Gate/Control Logic Electronics |
| 189 | Transistor/Thermocouple transistor |
| 190 | Transistor |

It should be understood that the drawings are not necessarily to scale. In certain instances, details that are not necessary for an understanding of the embodiments or that render other details difficult to perceive may have been omitted from these drawings. It should be understood, of course, that the embodiments are not limited to those particular embodiments illustrated in the drawings.

DETAILED DESCRIPTION

Varying embodiments of the present disclosure are described herein with reference to the drawings. It is expressly understood that although FIGS. 1-7 depict a fire and water display with integrated safety features, the decorative display is not limited to these embodiments.

Figure 2:
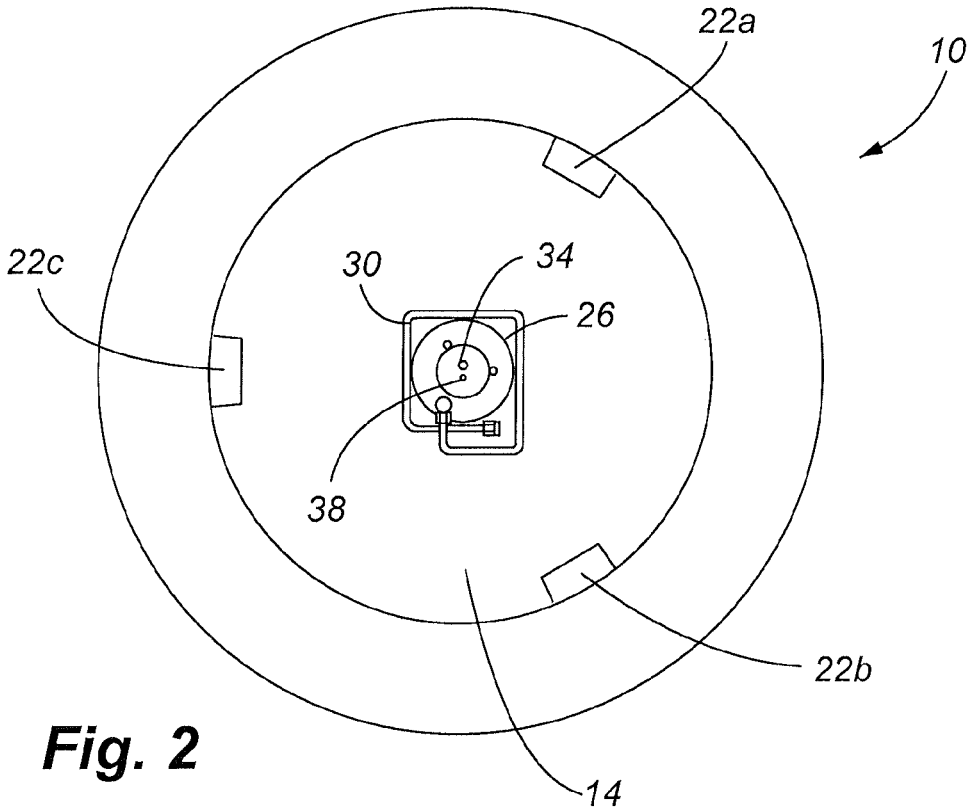
FIG. 2 is a top view of one embodiment of the decorative display.

Referring now to FIGS. 1-2, a fire and water display 10 with integrated safety features is shown. As shown, the fire and water display 10 comprises a basin 12 adapted for receiving and maintaining a volume of water 14 and may be supported by a base member 18. Although the fire and water display 10 depicted in FIGS. 1 and 2 is shown with a rounded or hemispherical basin 12, one of ordinary skill in the art will recognize that a variety of other reservoirs, basins, tubs, and containment devices may be employed for use in the fire and water display 10. For example, rectangular, cubic, pyramidal, asymmetric, and various poly-sided basins are within the scope and spirit of the decorative display. Furthermore, basin 12 may be disposed in a variety of orientations and need not comprise an above ground feature. By way of example only, one or more basins 12 of the decorative display may be at least partially buried or submerged in the ground or another structure such as a floor or elevated surface. In embodiments, a base structure 18 is provided which is generally adapted to support a reservoir 12. For example, a cradle structure having any combination of legs or supports, but preferably at least 3, is provided in various embodiments wherein the legs or supports of the base structure 18 hold a basin 12 in a certain position/orientation. One of skill in the art will recognize that a base structure 18 of the present invention may provide structural and/or aesthetic qualities.

In embodiments, the basin 12 further comprises one or more water delivery means 22*a*, 22*b*, 22*c* adapted for providing or directing water into an internal volume of water 14 disposed in the basin 12. For example, water delivery means 22*a*, 22*b*, 22*c* may comprise weirs which channel circulated water and allow the circulated water to fall into the internal volume of water 14 disposed in the basin 12 from a vertical distance above the surface of the water. The water may be circulated through a pump or other circulation means to be taken from the basin 12 and returned via the water delivery means 22*a*, 22*b*, 22*c*. Distribution and redistribution of water in this manner provides for desirable audio, visual, and aesthetic effects. Furthermore, in embodiments, weirs 22*a*, 22*b*, 22*c* serve to disturb the surface of the volume of water 14 and aerate the volume of water 14, thereby improving water heat rejection capabilities of the system. Preventing the water from heating reduces the risk of scalding. Circulation also slowsthe evaporation of water from the basin 12. Weirs 22*a*, 22*b*, 22*c*, or similar elements may further act to assist in the escape and combustion of gases 54 by disrupting the surface of the volume of water 14.

The fire and water display 10 can also comprise a combined water/flame unit 26 disposed within the internal volume of water 14 of the basin 12 and at least partially below the surface of the water. The combined water/flame unit 26 can include various features and devices, which may include gas provisioning means, flame ignition means, water control and sensing means, and various safety and control sensors. For example, a water/flame unit 26 of the fire and water display 10 is comprised of tubing or a channel which provides for a flammable gas having a density lower than that of water to be released at a submerged location and travel upward toward or float to the surface of the volume of water 14. For the purposes of the present disclosure, the terms down or downward refer generally to a direction that is parallel to the earth's gravitational pull, while up or upward refers generally to a direction opposite to the same. The water/flame unit 26, in embodiments, further comprises a pilot light 34 or similar ignition means disposed at a location generally above the surface of the water which serves to ignite flammable gases that escape from the volume of water 14. In embodiments, the combined water/flame unit 26 further comprises a thermocouple 38 which is adapted for detecting the presence and/or absence of a pilot light 34 flame. Various known thermocouples, including, by way of example only, those available in the Robert Shaw 1970 series, may be utilized in the fire and water display 10.

In embodiments, the system 10 may comprise automatic and/or remote control features for various system components, including, but not limited to a pilot light 34 and corresponding gas flow(s). For example, infrared or radio frequency devices may be utilized with the present invention 10 to communicate with the system (e.g. via an infrared receiver) from a variety of locations/positions. In embodiments, remote control features may comprise, in addition to or in lieu of infrared or radio frequency devices, a mechanical switch disposed at a distance away from a basin 12 and/or flame, such as within the comforts of a home or structure.

Flammable gases, particularly those which have a lower density than water and a higher density than ambient air, can collect at or near the surface of the water of the fire and water display 10 if not properly combusted. In embodiments, the present invention contemplates the use of gases with densities lower than that of ambient air (e.g. natural gas). One of skill in the art will recognize, however, that even when such gases are used, bleeding of un-combusted gas is generally undesirable. A collection of large volume of the gases creates a safety concern, where a potential flare up and the sudden ignition of the large volume of gas could occur. A flare up could cause serious harm to surrounding persons and objects. Thus, in order to solve problems associated with this known safety hazard, the fire and water display 10 includes a thermocouple 38 or similar device which is capable of detecting the disappearance or absence of the pilot light 34 and sending appropriate commands to additional system 10 components to, for example, to terminate the flow of gas to the system 10 through at least a main delivery portion 30.

Figure 3:
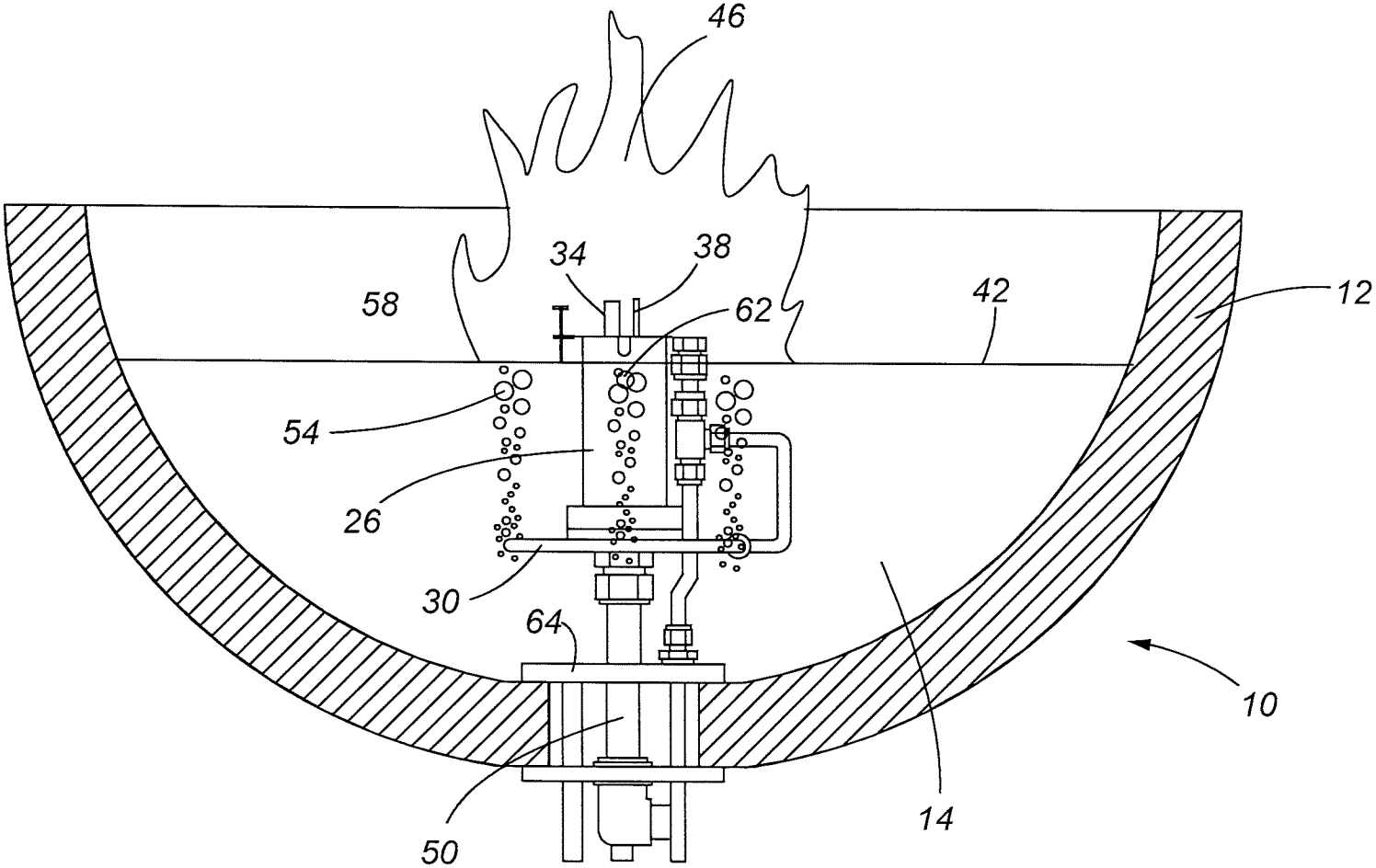
FIG. 3 is a cross-sectional elevation view of one embodiment of the decorative display.

Referring now to FIG. 3, a cross-sectional plan view of the fire and water display 10 is shown. A basin 12 is provided which is capable of maintaining a volume 14 of water or similar substance. In embodiments, the basin 12 of the fire and water display 10 is comprised of a material having sufficient durability, corrosion resistance, and capacity to receive and/or resist heat. By way of example only, basins 12 of the fire and water display 10 may be comprised of one of the following, but are not limited to, concrete, cast iron, copper, terra cotta, stone, brick, and clay. A flammable gas 54 is provided to and allowed to be expelled from tubing 30 at one or more locations. Although one of ordinary skill in the art will recognize that any number of apertures may be provided within tubing 30 to allow flammable gas 54 to escape into the volume of water 14, the fire and water display 10 may include at least one aperture along a length of a submerged portion of the tubing 30 to allow gas 54 to escape. In the embodiment shown in FIG. 3, the fire and water display 10 comprises a submerged length of tubing 30 comprising at least four distinct apertures to enable the escape and upward travel of the flammable gas 54.

The fire and water display 10 further contemplates that apertures formed within the tubing 30 may be positioned at a variety of locations and may be of a variety of sizes and/or diameters. However, in embodiments, the fire and water display 10 comprises one or more apertures of approximately 1.6 mm (1/16 inches) diameter submerged approximately four inches below a surface 42 of a volume of water 14 in sufficient volume to ensure safe and effective operation of the fire and water display 10. One of skill in the art will recognize that the gas must be released at a pressure equal to or greater than a hydrostatic pressure at a given location, which is generally dependent upon water depth. In embodiments, apertures may be disposed at depths approximately between zero and 14 inches. However, it will be recognized that gas apertures may be disposed at any number of depths and the gas pressure adjusted as needed.

One of ordinary skill in the art will recognize that apertures may be oriented in any number of positions along the tubing 30 or may be different size depending on the particulars of the fire and water display 10. For example, the apertures may be disposed on an upper portion, a lower portion, a side portion, or any number of locations there between in the tubing. In embodiments, the apertures are formed in the underside portion of the tubing in a generally downward facing position. Furthermore, while the size and orientation of The tubing 30 may vary widely for the purposes of the fire and water display 10, one embodiment contemplates a coil or rectangular loop of tubing 30 comprising a total width or diameter of approximately 20 cm (8 in.). One of skill in the art will recognize, however, that gases 54 released from the tubing 30 should preferably surface at a location sufficiently near to the pilot light 34 so that gases 54, which escape from the surface of the water 42 are allowed to combust and generate flame(s) 46. In the embodiment shown in FIG. 3, the pilot light 34 is approximately centered on the center axis of the coil of tubing 30. FIG. 3 further depicts buoyant gases 54 rising through the volume of water 14 toward the surface of the water 42, whereupon the gases 54 are combusted due to their proximity to one or more pilot lights 34, creating a flame 46 at or above the surface of the water 42 in a generally erratic and dynamic manner. The resulting flame 46 produces desirable aesthetic characteristics and energy in the form of heat to the surrounding environment. As previously discussed and as will be understood by one of skill in the art, combustion of gases 54 is at least partially dependent upon the relative distance between the gas 54 and a pilot light 34. Therefore, the quantity of water disposed within a basin 12 of the fire and water display 10 and the resulting' difference between water line of the surface of the water 42 and pilot 34 (shown as "d" in FIG. 3) is an important functional consideration of the fire and water display 10. For example, if d is too great, gases 54 will escape the water line 42 at a location that does not allow for proper combustion, thus resulting in accumulation of flammable gas 54 at the surface 42 and potentially resulting in a dangerous flare ups or explosions when the accumulated gas 54 reaches a critical volume. Alternatively, if d is too small, the volume of water poses a risk of extinguishing and/or engulfing the pilot light 34 of the fire and water display 10, which can result in a similar accumulation of flammable gas 54 and associated risks. In embodiments, the fire and water display 10 contemplates maintaining a distance d between the surface of the water 42 and a pilot light 34 that is between approximately 0.5 and 6 inches. In embodiments, the fire and water display 10 contemplates maintaining a distance d between a water line 42 and a pilot light 34 that is between approximately 1.0 and 4.0 inches. In the embodiment shown in FIG. 3, the fire and water display 10 contemplates maintaining a distance d between the surface of the water 42 and a pilot light 34 that is approximately between 0 and 3 inches. In another embodiment, the fire and water display 10 contemplates maintaining a distance d between the surface of the water 42 and a pilot light 34 that is approximately between 1.25 inches and 2.25 inches. The fire and water display 10 therefore contemplates a number of means to both monitor and control the level of water 42 of the fire and water display 10.

In embodiments, the surface level of the water 42 of the fire and water display 10 is controlled at least partially by balancing the mass flow rate between water exiting through a drain 64 disposed at a point of lower gravitational potential energy and water supplied to the internal volume 14 of the basin 12. For example, water exiting through a drain 64 due to the force of gravity and/or pumping means may be restored to a main volume 14 of the basin 12 by a re-circulation pump. One of skill in the art will recognize a wide variety of re-circulating pumps which may be suitable for use within the fire and water display 10, such as the Little Giant® model no. 3E-34N. It will further be recognized that the size and type of pump may be varied based on the specific application and desired size of the combined water and fire display 10.

In another embodiment, the fire and water display 10 comprises means for controlling or accommodating unexpected and/or undesired rises in water level 42. It will be recognized that, even where water drainage, circulation, and redistribution means are employed, an undesired increase in water level 42 may occur due to a variety of factors. For example, where a combined water/fire display 10 is exposed to the elements, the water level 42 may rise during periods of precipitation due to the basin's inherent ability to collect precipitation. One of skill in the art will recognize that where water levels 42 rise above acceptable limits, the water level 42 may threaten the safe and effective operation of the device 10. For example, an exceedingly high water level 42 may extinguish the pilot light 34, potentially damaging features of the fire and water display 10 and posing safety risks as discussed herein. Therefore, in embodiments, the fire and water display 10 comprises at least one overflow drain 58 which serves to drain water by gravitational effect before the surface of the water 42 reaches an unacceptably high level. Although FIG. 3 depicts an overflow drain 58 disposed at an upper portion of a combined water/flame unit 26, one of skill in the art will recognize that such a drain 58 may be disposed at a variety of locations within the device 10. For example, one or more perforations or apertures may be formed through the width of the basin 12 at or below a point corresponding to a maximum acceptable water level 42.

In addition to complications associated with allowing a water level 42 to reach unacceptably high limits, it is also known to be undesirable to allow the water level 42 to sink or lower below a certain limit. It is known, for example, that open volumes of water which are left exposed to many natural environments will gradually evaporate. Furthermore, energy given off in the form of heat from aspects of the fire and water display 10 will generally act to increase the temperature of a volume of water 14 and increase the rate of evaporation, and thus, reducing the volume of water contained within the basin 12 and the resulting surface level of the water 42. As previously discussed, an excessively low surface level of the water 42 poses a variety of safety risks, e.g., flare-ups or explosions of accumulated gasses. Accordingly, the fire and water display 10 comprises features designed to detect and/or remedy an unacceptably low water level 42.

In embodiments, the fire and water display 10 comprises at least one water level sensor 62 which is capable of detecting the absence of water at a certain vertical height within the basin 12. Water level sensors 62 of the fire and water display 10 may be adapted for transmitting a variety of signals. For example, the water level sensor 62 has the ability to detect the absence of water at a certain location/height within the basin 12 and controls the main gas valve to shut-off to shut off if the water is not high enough within the basin 12. Thus, the water level sensor 62 can prevent the undesired accumulation of large quantities of gas at the surface of the water 42 by ensuring the gas exits the water close enough to the pilot light 34. In an alternative embodiment, a water level sensor 62 is coupled to an auto-fill feature of the fire and water display 10. For example, the water level sensor 62 is capable of sending a signal to a water supply source (e.g., a hose or water supply pipe with an electronic valve) to add water or a desired substance to the basin 12 until a water level sensor 62 detects the presence of water a certain location/height, whereupon the addition of water to the system 10 is terminated.

Figure 4:
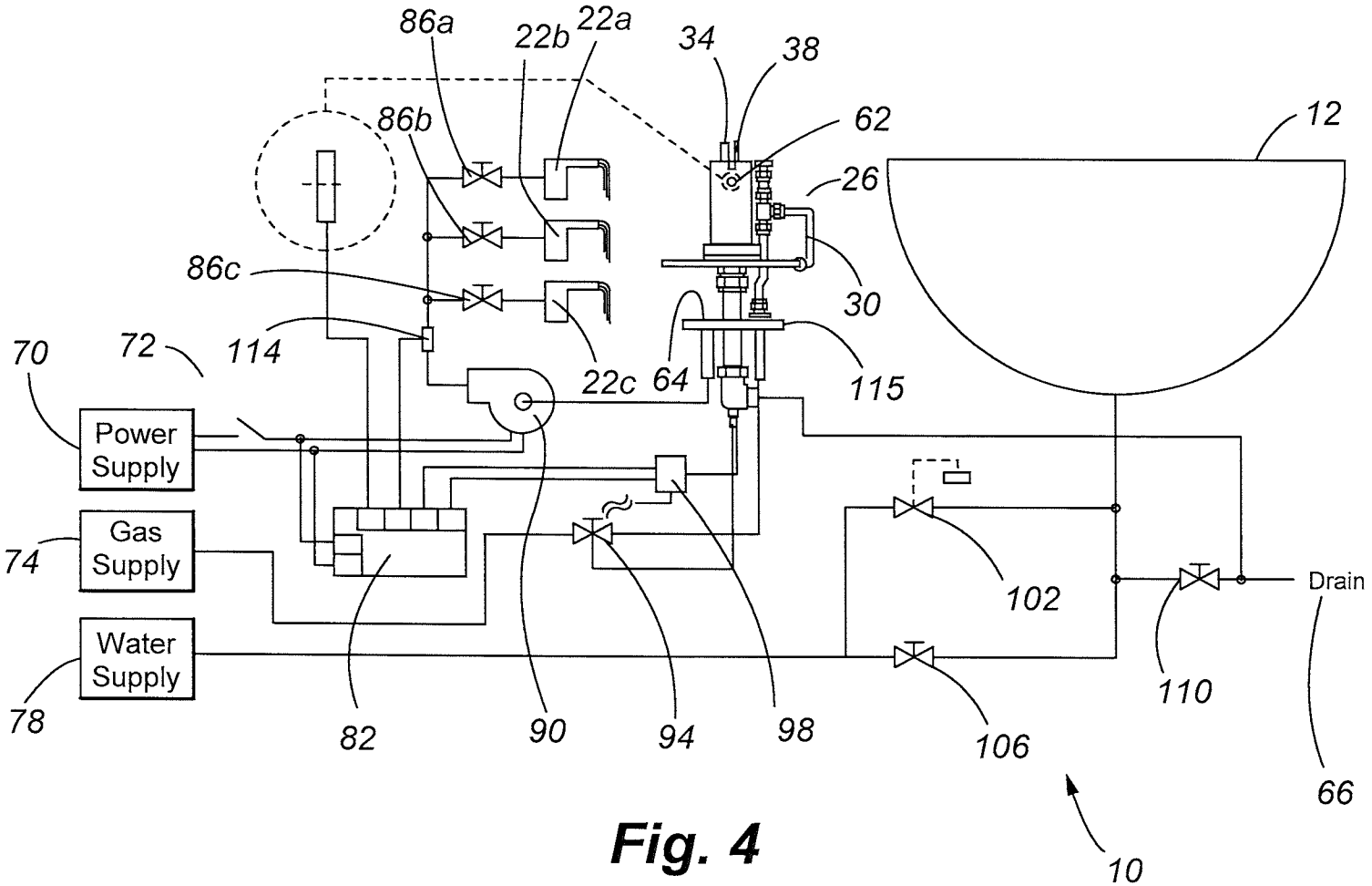
FIG. 4 is a schematic of one embodiment of the decorative display.

FIG. 4 is a schematic depicting various features and interconnections within the fire and water display 10. As shown, a basin 12 is provided with a combined gas and flame unit 26 and various components connected thereto and associated therewith. In embodiments, the fire and water display 10 comprises three primary supply units including a main power supply 70, a main gas supply 74, and a main water supply 78. The power supply unit 70 of the fire and water display 10 may be comprised of a standard 120 Volt A.C. power supply, such as that available through standard wall outlets in the United States. The power supply unit 70 may further comprise a toggle switch 72 for binary control of the supply of power to the system 10. Various known switches 72 may be employed in the fire and water display 10, including, but not limited to a commercially available single pole 30 Amp, 120 Volt switch. The power supply unit 70 provides power to various features of the fire and water display 10. For example, the power supply unit 70 may provide electrical energy to one or more water pumps 90, interlock control boards 82, lighting elements (not shown), and various other devices and features which require power.

As further shown in FIG. 4, the fire and water display 10 further comprises at least one gas supply source 74 for providing combustible gas to one or more features of the fire and water display 10. In embodiments, a gas supply source 74 provides gas to at least one combined water/flame unit 26. Combustible gases as contemplated by the fire and water display 10 may comprise, by way of example only, propane, natural gas, butane, acetylene, cyclopropane, ethane, ethylene, ethyl chloride, isobutan, methane, methyl chloride, propylene, hydrogen and silane. By way of example only, gas supplies 74 suitable for use with the fire and water display 10 may comprise various standard sized propane tanks (e.g. 20 lb, 30 lb, 100 lb, etc. tanks), which may be connected to the system 10. Alternatively, the fire and water display 10 may be connected to a mainline infrastructure, such as private or municipal natural gas line, which can offer a generally continuous supply of fuel to the system 10. Various other known connections, as will be obvious to one of ordinary skill in the art, are also within the scope and spirit of the fire and water display 10.

In embodiments, the fire and water display 10 comprises a water supply source 78. Water supply sources suitable for use with the fire and water display 10 comprise, for example, existing plumbing systems and infrastructure and stand-alone reserves of water (e.g. a tank or reservoir contained within or remote from and connected to a basin 12). In embodiments, a water supply source 78 further comprises at least one hand valve 104 for manually controlling the supply of water to a basin 12. Hand valves suitable for use in various portions of the fire and water display 10, including but not limited to, the interconnection between a water supply 78 and the basin 12, include ball valves, butterfly valves, choke valves, check valves, diaphragm valves, solenoid valves, gate valves, globe valves, knife valves, needle valves, piston valves, pinch valves, plug valves, spool valves, and various other known valves for regulating, initiating, and/or terminating flow. Thus, in embodiments, when the system 10 and/or a user determines that the quantity of water contained within a basin 12 of the system 10 is inadequate, a valve 106 may be appropriately positioned to initiate water flow to the basin 12. Once a desired water level 42 has been achieved, the valve 106 may be shut-off.

In an alternative embodiment, the fire and water display 10 need not be connected or connectable to a water source 78. One of skill in the art will recognize that the system 10 may be operated without being connected to a water supply source. For example, a volume of water may be added to the system 10 (e.g. through filing the internal volume of water 14 of the basin 12 via one or more external water sources) and the volume of water 14 is then circulated in a closed-loop manner without the need to continually add or supply water, at least until the water evaporates.

In embodiments, the fire and water display 10 further comprises a float valve 102 for maintaining and/or controlling a water level 42 within a basin 12 of the fire and water display 10. For example, an additional water basin or reservoir may be provided that is interconnected with a basin 12 of the fire and water display 10 in a manner that results in the height of the volume of water within a basin 12 corresponding to that of the additional reservoir. The additional reservoir may further comprise a float valve 102 which is adapted to initiate the flow of water to the system once the water level and float device sinks or passes below a specific height. Similarly, the float valve 102 of the fire and water display 10 is adapted to terminate the flow of water to the system once the water level and float return to appropriate and/or desired levels. Although FIG. 4 depicts a water supply 78 of the fire and water display 10 connected to a basin 12 with an intervening hand valve 106 and float valve 102, one of skill in the art will recognize a variety of ways by which a water supply 78 may be interconnected to the system 10. For example, a water supply 78 may be connected to the system 10 in a manner that enables routing or directing water through one or more weirs 22*a*, 22*b*, 22*c* of the fire and water display 10 when desired.

Furthermore, the fire and water display 10 is not limited to any specific number or types of connection lines or valves. One of skill in the art will recognize that any number of valves and connection members may be provided to direct and redirect water and/or gas in desired ways.

As further shown in FIG. 4, the fire and water display 10 contemplates circulation system for water within the basin 12 in a manner that provides various functional and aesthetic advantages. In embodiments, at least one drain 64 is disposed within a combined water/flame unit 26 of the fire and water display 10, which channels water to a circulation pump 90 that directs water from a main volume 14 of a basin 12 to one or more culverts or weirs 22*a*, 22*b*, 22*c* and back to a main volume 14 of a basin 12. In embodiments, flow rates to weirs 22*a*, 22*b*, 22*c* are at least partially controlled or governed by hand valves 86*a*, 86*b*, 86*c*. Thus, where a user desires to alter, initiate, or terminate flow to one or more weirs 22*a*, 22*b*, 22*c*, the appropriate hand valve 86*a*, 86*b*, 86*c* may be manipulated accordingly. In an alternative embodiment, the fire and water display 10 comprises the use of as few as one valve to control or dictate flow to weirs 22*a*, 22*b*, 22*c*. For example, a multi-directional valve may be employed to control flow to weirs 22*a*, 22*b*, 22*c* at a single point or a single valve with a manifold. Furthermore, various embodiments of the fire and water display 10 comprise various devices and methods for redelivering water to a main volume 14 of the basin 12. For example, in addition to or in lieu of weirs 22*a*, 22*b*, 22*c*, nozzles, fountains, streams, submerged jets, waterfalls, piping, and/or various ornamental devices and means (e.g. a cherub or one's favorite college mascot) may be implemented for delivering water to a basin 12 or reserve may be utilized.

In embodiments, the fire and water display 10 comprises at least one temperature sensor 114 disposed within the system 10. This temperature sensor 114 continually monitors the temperature of water in the system and is capable of sending one or more signals to an interlock control board 82 to terminate gas flow to the system 10 if the water temperature exceeds a maximum specified temperature. One of skill in the art will recognize the various safety concerns associated with allowing water temperature within the system 10 to exceed certain predetermined values. For example, it is generally known that the human pain threshold for contact with water is approximately 43 degrees Celsius and temperatures higher than 43 degrees Celsius can result in scalding. Thus, as the fire and water display 10 is contemplated for use with various people, animals, etc. within a close proximity, various means, including a temperature sensor 114 and associated logic are contemplated to terminate gas flow and associated flames 46 when or before dangerous temperatures are reached. One of skill in the art will recognize that various temperature sensors may be utilized with the present invention, including, but not limited to thermocouples, contact sensors, noncontact sensors, thermal imaging devices, resistance thermometers, and thermistors.

One of skill in the art will recognize that the system 10 comprises a combination of moving as well as generally stationary water and a plurality of components of different composition and different proximity to a flame 46. Accordingly, various components and locations within the system 10 will be impacted to greater or lesser degrees by the flame 46 and/or reach significantly higher temperatures than other locations and components. Therefore, in embodiments, the fire and water display 10 comprises a plurality of temperature sensors 114 disposed at various locations throughout the system 10. The plurality of temperature sensors 114 may be positioned so as to acquire temperature information from numerous locations, such locations including points within flowing water, within generally stagnant water, and within or on structural portions, such as, the basin 12 sidewalks) or various other features of the system 10. In embodiments, the fire and water display 10 is capable of terminating a main gas flow if any one or more of these temperature sensors exceeds a maximum predetermined limit In an alternative embodiment, the system 10 is capable of computing an average from the plurality of temperature sensors 114 and terminating gas flow if this average temperature is in excess of a predetermined value. In yet another embodiment, the system 10 is capable of displaying one or more temperatures as determined by sensors 114 and allows a user to take a number of actions, such as terminating or restricting gas flow and increase or alter water levels.

In embodiments, the system 10 comprises at least one filtration device (not shown). Filtration devices of the present invention may comprise, for example, one or more activated carbon filters adapted for removing solids and/or other contaminates from a volume of water or liquid. One of skill in the art will recognize that various forms of debris and contamination may build up in system 10, such as plant and algae growth, soot from combustion components, as well as various other solids that may be produced from system components or external environment. Such contamination may cause deleterious effects upon the appearance, aroma, and/or function of the system 10. Accordingly, various filtration devices may be implemented. For example, where gases used in the system 10 comprise odorants, activated carbon filters and/or similar devices may be implemented to remove and/or prevent accumulation of such unpleasant substances.

In embodiments, one or more filtration devices are located immediately downstream of a water pump 90 and upstream of diversions leading to weirs 22*a*, 22*b*, 22*c*. It will be recognized, however, that one or more filtration elements may be disposed at various locations throughout the system. For example, one or more filtration devices may be disposed proximal to weirs 22*a*, 22*b*, 22*c*.

Furthermore, it will be recognized that any number and/or combination of filter devices may be implemented within the system 10. In embodiments, one or more screen filters primarily adapted to remove large-scale contaminates is provided in combination with an activated carbon filter which is primarily adapted to remove smaller particles. Filter devices such as diatomaceous earth filters, sand filters, and cartridge filters may be employed in embodiments of the fire and water display device.

Figure 5:
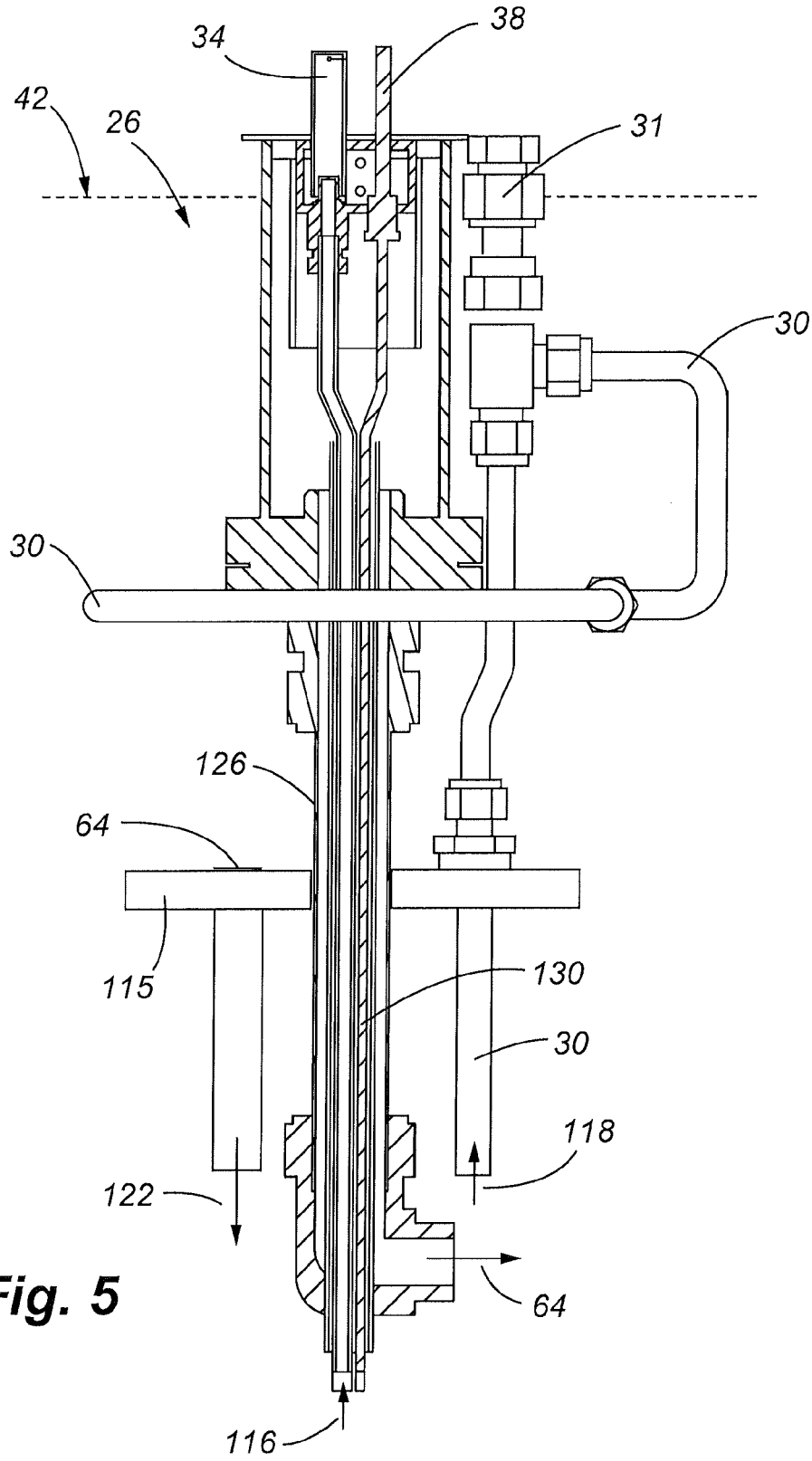
FIG. 5 is a cross-sectional elevation view of one component of one embodiment of the decorative display.

Referring now to FIG. 5, a cross-sectional elevation view of a combined water/flame unit 26 is shown. In embodiments, the combined water/flame unit 26 of the fire and water display 10 comprises multiple features including, but not limited to, gas features, water sensing and control features, and electrical/signal features. In embodiments, at least two gas feeds 116, 118 gas feeds are provided from, for example, a main gas supply (74 in FIG. 4). Gas flow 116 is provided to a pilot light 34 disposed at an upper portion of the assembly 26 at least partially due to a pressure drop between the supply and a pilot light 34. Various known and commercially available pilot lights may be used within the fire and water display 10. For example, the Baso J998MDA2 pilot burner may be employed to create and maintain a pilot light than bums continuously (i.e. absent interruption from outside events such as precipitation, wind, or loss of fuel).

As shown and described herein, the pilot light 34 is adapted for igniting flammable gases which are released from additional elements of the system 10 and allowed to surface due to differences in density between the gases and water. The thermocouple 38 is further adapted to detect the presence and/or absence of a pilot light 34 flame and relay a signal via wiring 130 to a thermocouple junction block 98, which is capable of communicating with an interlock control board 82 and/or a gas valve 94, which is further capable of terminating gas flow to a pilot light 34. Gas valves 94 suitable for use within the fire and water display 10 include, but are not limited to commercially available valves such as the Baso® H15 series automatic pilot valves.

In embodiments, an additional gas flow 118 is provided which serves to provide a primary source of gas to be released within a volume of water and combusted upon reaching and/or breaching the surface of the water 42. This primary gas flow 118 originates from the main gas supply 74, and may be subsequently channeled through a gas delivery line 30. In order to avoid complications arising from water entering submerged gas lines, the fire and water display 10 comprises various novel features useful for providing gas to and releasing gas from one or more submerged locations. In addition to providing a gas pressure which is preferably greater than the water pressure at the depth of the deepest submerged gas outlet, addition features are contemplated to prevent water intrusion into the gas lines in case gas pressure is lost or interrupted due to a variety of reasons. One such feature 31, as will be described herein, includes directing gas flow 118 to a location of greater vertical height than a maximum allowable water level 42 before channeling gas 118 to a submerged location where it is to be released.

In embodiments, the combined gas/water assembly 26 comprises a central channel 126 which houses a gas flow 116, thermocouple connection 136, and a channel connected to the overflow drain 58. One or more components of the assembly 26 are supported by and/or connected to a flange 114 which provides support for various features of the fire and water display 10.

Figure 6:
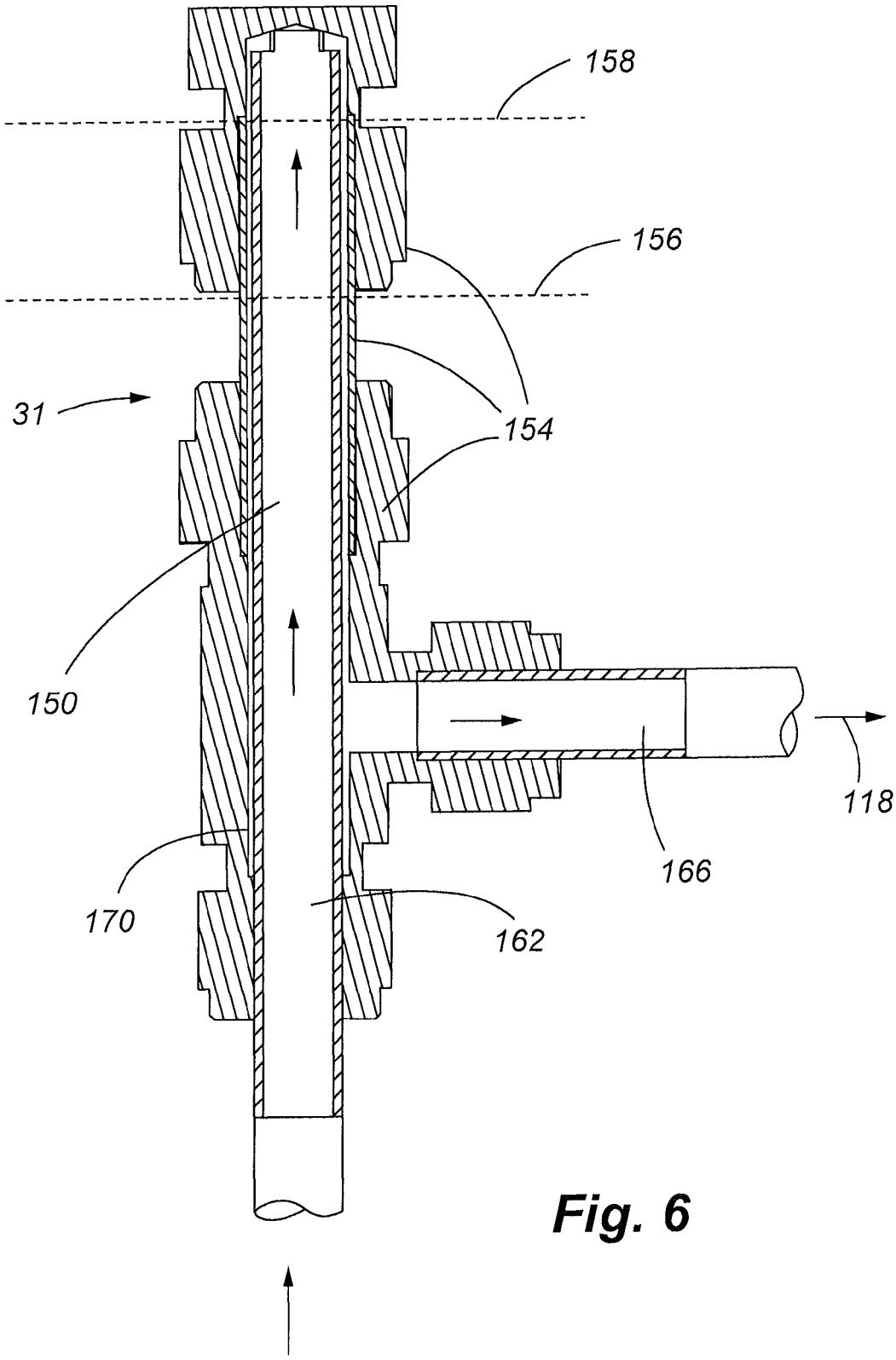
FIG. 6 is a cross-sectional elevation view of one component of one embodiment of the decorative display.

FIG. 6 is a cross-sectional view of the direction of primary gas flow 118 through a portion of the system according to one embodiment. As shown, gas flow 118 is provided through a first tube 150 or conduit by means of at least a pressure differential to an outlet disposed at an upper region of the tube 150 which is disposed above a maximum allowable level 158 as defined and controlled by various features described herein. Upon reaching an outlet, the gas flow 118 is directed downwardly through a second tube 154 or conduit having an internal diameter greater than an outer diameter of the first tube 150. In embodiments, the first 150 and second 154 tubes are joined together at a lower portion 162 in a manner that substantially prevents the flow of water and/or gas, such as through welding, appropriate threaded connections, and/or gaskets. Gas flowing downwardly through a channel 170 defined by an outer diameter of the first tube 162 and an inner diameter of the second tube 154 is ultimately directed outwardly through an exit portion 166 to apertures which provide the gas 118 to a volume of water contained within a basin 12. Although FIG. 6 depicts an exit portion 166 as being disposed generally horizontally, one of skill in the art will recognize that a variety of orientations for this exit portion 166 are within the scope and spirit of the fire and water display 10. Accordingly, the tube-in-tube or snorkel arrangement 31, as shown and described in conjunction with FIGS. 5 and 6, prevents water from entering the gas delivery portions of the system 10 as it is well known that water will not be able to travel above a high water limit 158 without forces in excess of those imparted by gravity and atmospheric pressure.

In embodiments, gas line connections are provided wherein a mechanical connection or union coupling is provided at the lowest point in a gas line. In such embodiments, the mechanical connection may be disconnected in the event that water has entered the gas line in order to drain the water via gravity and/or blow out the gas line. In embodiments, a valve may be positioned at this point to further assist in draining and/or purging water from a gas line.

Figure 7:
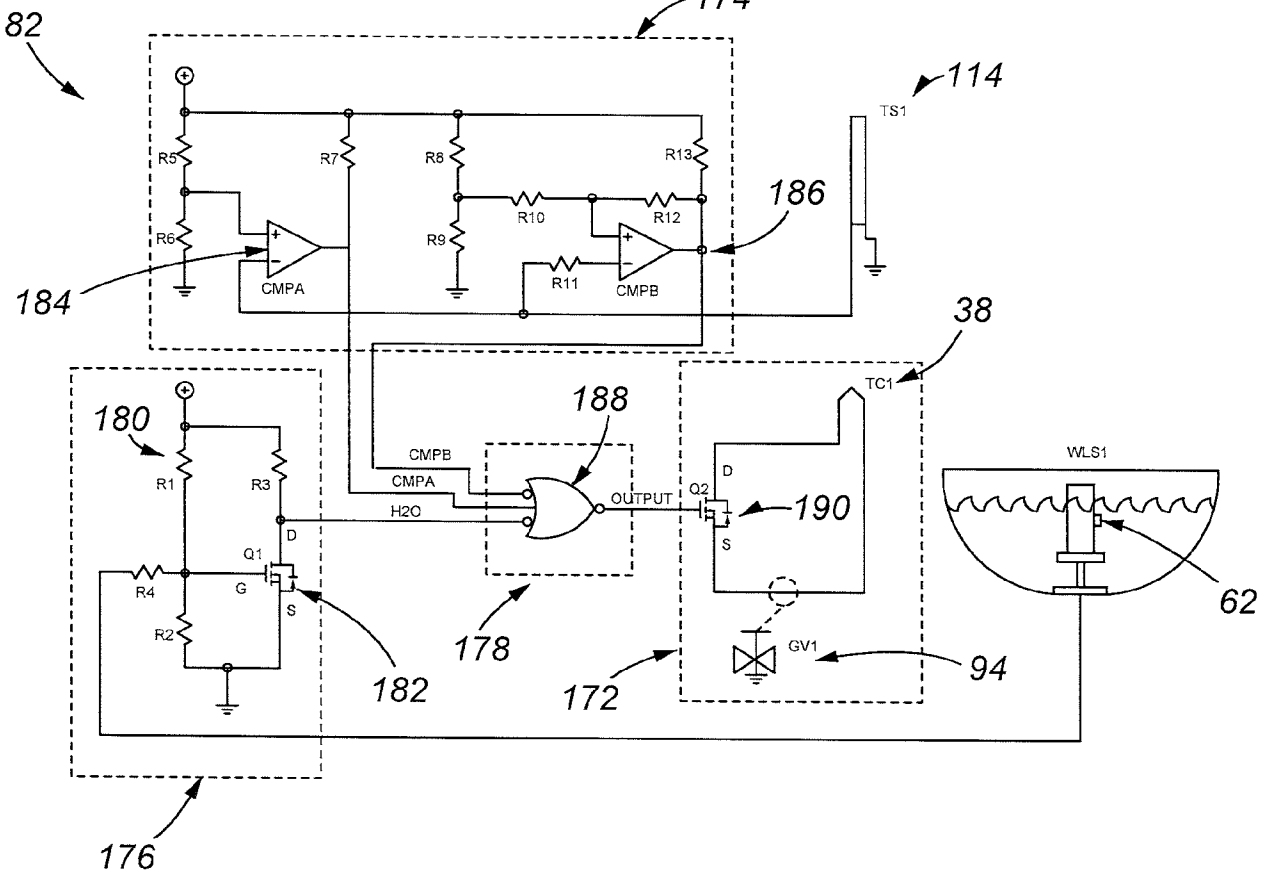
FIG. 7 is a circuit diagram of one embodiment of an interlock system with various control circuitry.
Figure 8:
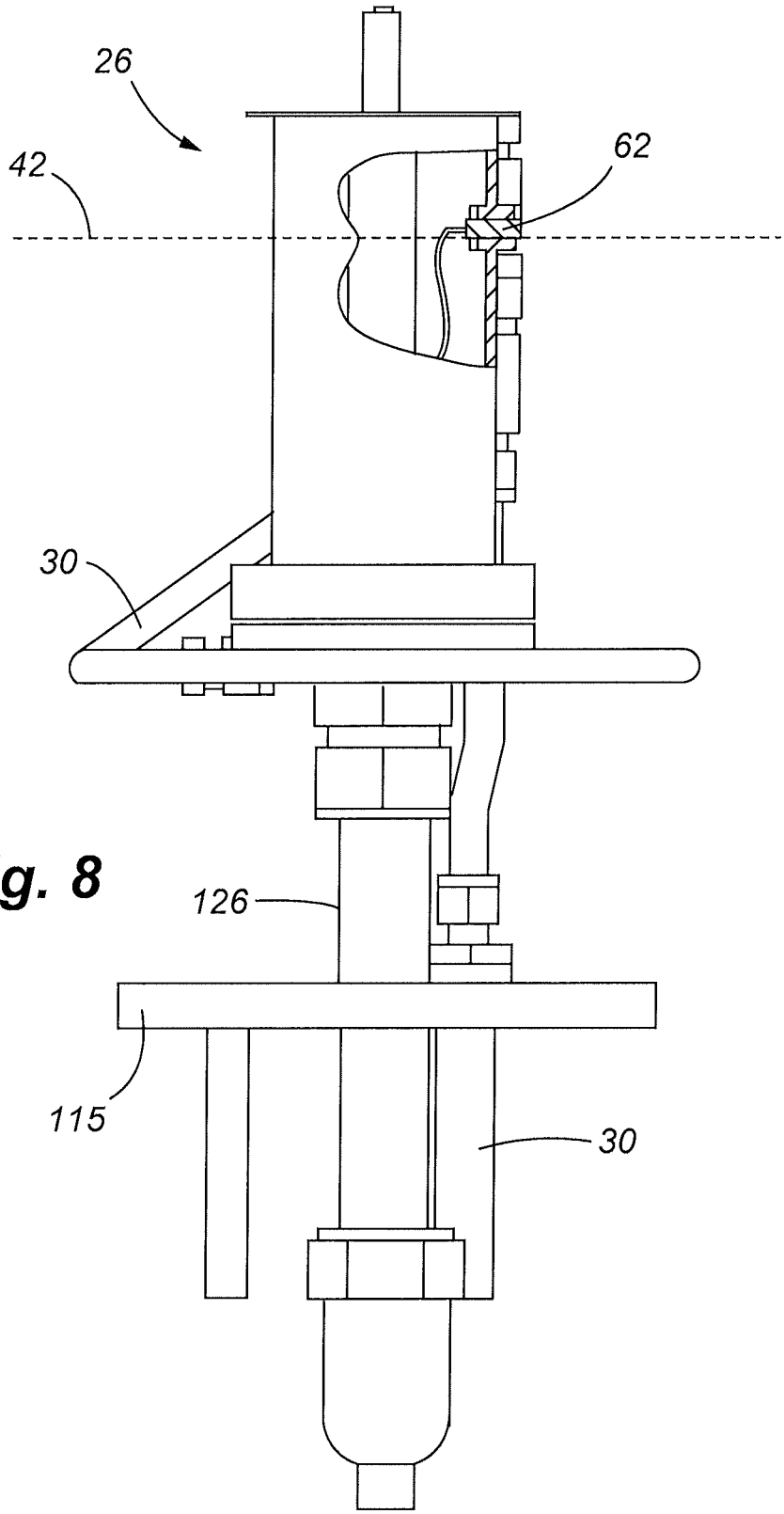
FIG. 8 is an embodiment a combined fire and water component showing a water level sensor positioned at a predetermined location.

An embodiment of an interlock system control board 82 that provides the electronic safety controls for the first and water display 10 is shown in FIG. 7. The electronics of the interlock system control board 82 are generally separated into the temperature control electronics 174, the thermocouple circuits 172, the water level control electronics 176, and the interlock electronics 178. Generally, the interlock system control board 82 receives power from a switch (not shown) that provides power to the water pump 90. Thus, the main water pump 90 can be be powered on during normal operation to circulate water and help reject heat from the system. The switch used to control power to the pump 90 can also provides power the safety interlock electronics. Thus, the electronics on the interlock system control board 82 are powered on when the pump is powered on. In embodiments, the electronics of the interlock system control board 82 open the thermocouple circuit 172 when the interlock system control board 82 is not powered to prevent the unit from being operated without safety controls.

The water level control electronics 176 can include a connection to the water level sensor 62, a voltage divider network (i.e., the several resistors shown), and a transistor 182. The transistor functions as a logic gate that outputs a logic high when the water level is above the water level sensor (i.e., there is enough water in the basin 12) and a logic low when there is not enough water in the basin 12. The logic signal from the transistor 182 is sent to the interlock electronics 178. The resistor network ensures proper operation of the transistor 182 at either the low water condition or the adequate water condition. In embodiments, the source voltage is +5 volts and the values of the resistors in the voltage divider network are R1 is 100 kOhms, R2 is 1 MOhms, R3 is 10 kOhms, and R4 is 10 kOhms. The transistor may be an NTR4003 from ON Semiconductor (General purpose N-channel MOSFET).

The temperature control electronics 174 can include two comparators 184 and 186 connected to a temperature sensor integrated circuit 114. Comparator 184 detects the presence and proper function of the temperature sensor integrated circuit 114. If the temperature sensor integrated circuit 114 is absent or malfunctioning, the comparator 184 will send a signal to the interlock electronics 178 to prevent operation of the fire and water display 10. Comparator 186 detects if the water temperature has reached a temperature at or above 60° C. If the temperature is at or above 60° C., the comparator 186 will send a signal to the interlock electronics 178 to prevent operation of the fire and water display 10. The comparator 186 is designed with hysteresis such that the signal from the comparator 186 will remain until the temperature of the water returns to at or below 40° C. Example comparators used in the temperature control electronics 174 can include the LM393 (a Dual, Open-collector comparator) from ON Semiconductor (dual, open-collector comparator). The input voltage to the temperature control electronics 174 may be 5 V DC and the resistor values (in Ohms) in the temperature control electronics 174 are R5 is 8,000, R6 is 40.2, R7 is 10,000, R8 is 4,400, R9 is 460, R10 is 100, R11 is 100,000, R12 is 8,000, and R13 is 10,000.

In embodiments, the comparator 184 is adapted to detect if a water temperature is too low. Based on resistor values provided, the comparator may signal a main valve to shut off gas flow if the water temperature is below a predetermined minimum. For example, embodiments may provide for the prevention and/or termination of gas flow when water reaches a temperature at which freezing and corresponding build-up of gas within the system is a concern (e.g. 2.5 degrees Celsius).

The signals from the temperature control electronics 174 and the water level control electronics 176 are sent to the interlock electronics 178. The interlock electronics 178 includes a NOR gate 188 NOR gates and associated electronics are well known in the art and will not be described further hereinafter. The inputs from comparator 184 and from the water level control electronics 176 are inverted. The truth table for the NOR gate is as follows:

| Comparator 184 | Comparator 186 | Water level control electronics 176 | NOR gate 188 Output |
|---|---|---|---|
| 0 | 0 | 0 | 0 |
| 0 | 0 | 1 | 0 |
| 0 | 1 | 0 | 0 |
| 0 | 1 | 1 | 1 |
| 1 | 0 | 0 | 0 |
| 1 | 0 | 1 | 0 |
| 1 | 1 | 0 | 0 |
| 1 | 1 | 1 | 0 |

The system is in a safe operating condition when the output of the NOR gate 188 is a logic high and causes the conduction of the transistor 190, which opens the gas valve 64. It should be noted that the thermocouple 38 can also cause the gas valve 94 to close.

In various embodiments, the fire and water display 10 comprises a convertible system, which does not require the use of both water and fire. For example, in embodiments, the fire and water display 10 may be at least partially devoid of a volume of water and filed with a variety of substitutes. These substitutes include, but are not limited to gas-permeable arrangements of rock, coal, sand, gravel, glass, concrete, ceramic, metal, brick, and various combinations thereof. Features of the fire and water display 10, as shown and described herein, may be operated in a similar fashion, with gas percolating or rising through a ballast that is at least partially comprised of a material other than water. Such operation of the fire and water display 10 may be suitable or desired, for example, in cold locations and/or seasons where water may freeze. However, it will be recognized that the fire and water display 10 comprises various heating means and water circulation means which generally prevent the freezing of water used with the system 10, thus enabling combined water and fire usage in a wide number of regions and throughout various seasons.

In an alternative embodiment, gas and fire features of the fire and water display 10 may be disabled and the unit may be allowed to operate solely as a water display system. It will be recognized that although the system 10 as shown and described is generally designed to provide a combined water and fire display apparatus, the recirculation and running of water is not necessarily codependent with the gas and fire features of the fire and water display 10. Thus, embodiments of the fire and water display 10 may be utilized at least occasionally as a water-only or a water and light display.

While various embodiments the fire and water display 10 have been described in detail, it is apparent that modifications and alterations of those embodiments will occur to those skilled in the art. However, it is to be expressly understood that such modifications and alterations are within the scope and spirit of the fire and water display 10, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as; additional items.

What is claimed is:

1. A combined water and fire display system comprising:
a reservoir containing a volume of water;
at least one water source associated with said reservoir;
at least one power source associated with said system;
at least one source of flammable gas associated with said system; and
a unit for emitting flammable gas disposed at least partially beneath said volume of water, said unit comprising:
(a) a first gas line for directing flammable gas from said at least one source of flammable gas to one or more locations beneath the surface of a volume of water, wherein a portion of said first gas line extends above a predetermined maximum allowable water level so as to prevent the unwanted entrance of water into at least a portion of said first gas line;
(b) at least one water level sensor, wherein said water level sensor is operable to control one or more control valves operable to selectively terminate a flow of said flammable gas upon detection of an absence of a pilot light flame and operable to selectively transmit water from said water source to said reservoir upon the detection of an absence of a predetermined quantity of water;
(c) a recirculation drain;
(d) an overflow drain;
(e) a pilot light positioned above said volume of water for igniting said flammable gas;
(f) a second gas line for directing flammable gas from said at least one source of flammable gas to said pilot light;
(g) a thermocouple for determining if said pilot light is lit, said thermocouple operable to communicate with one or more control valves to selectively terminate a flow of said flammable gas from said source of flammable gas upon detection of an absence of pilot light flame; and
wherein said recirculation drain is in selective communication with at least one pump connected to a plurality of selectively operable channels that return water to said reservoir.

2. The combined water and fire display system of claim 1, wherein said at least one source of flammable gas comprises a quantity of propane.

3. The combined water and fire display system of claim 1, wherein said flammable gas supplied by said first gas line carries a gas having a lower density than water and a higher density than air, said flammable gas being allowed to rise through said volume of water and wherein said flammable gas is ignited by said gas ignition means substantially upon reaching a surface of said volume of water.

4. A combined water and fire display system comprising:
- a reservoir adapted to hold a predetermined volume of water;
- a pump associated with said reservoir;
- a power source associated with said system; and
- a water and fire unit disposed within said reservoir that is adapted to receive flammable gas, said water and fire unit comprising:
  - a gas line adapted for directing flammable gas to a location within said reservoir;
  - a control valve for selectively terminating the flow of flammable gas through said unit;
  - a means for sensing water level in communication with the control valve, said means for sensing water level operable to determine if said reservoir is holding the predetermined volume of water and controlling said control valve to terminate the flow of flammable gas upon the occurrence of a first predetermined condition;
  - a means for igniting gas;
  - a means for sensing temperature in communication with said control valve, said means for sensing temperature operable to determine a status of said means for igniting gas and controls said control valve to terminate the flow of flammable gas upon the occurrence of a second predetermined condition.

5. The combined water and fire display system of claim 4, wherein said reservoir comprises a hemispherical basin substantially impermeable to water.

6. The combined water and fire display system of claim 4, wherein said water and fire unit comprises:
- a first gas line of a predetermined length adapted for supplying a flammable gas to a plurality of locations within said reservoir, said plurality of locations disposed on a length of said first gas line disposed within the volume of water contained by said reservoir; and
- second gas line adapted for supplying flammable gas to said means of igniting gas.

7. The combined water and fire display of claim 4, wherein said means for igniting gas comprises a pilot light.

8. The combined water and fire display of claim 4, wherein said means for sensing temperature comprises a thermocouple.

9. The combined water and fire display of claim 4, wherein said means for sensing water level comprises a sensor adapted for detecting the absence of the predetermined volume of water.

10. The combined water and fire display of claim 4, wherein at least a portion of said first gas line extends above a height greater than a predetermined maximum water level of said reservoir.

11. A decorative display comprising:
- a fire unit positioned in a fluid reservoir, said fire unit connected to a power source and to a flammable gas source, a flow of the flammable gas being controlled by a control valve that is capable of terminating the flow thereof, wherein said fire unit is disposed at least partially within the reservoir, the fire unit comprising:
  - a section of tubing that receives the flammable gas from the flammable gas and releases the flammable gas to a location within the reservoir;
  - a pilot light for igniting the flammable gas after the flammable gas is released from said section of tubing; and
  - an interlock system in communication with the control valve, the interlock system operable to signal the control valve to terminate the flow of the flammable gas upon an occurrence of a condition, wherein the interlock system comprises interlock electronics operable to signal said control valve to terminate the flow of the flammable gas upon a signal from a water temperature electronics or a water level control electronics.

12. The decorative display of claim 11, further comprising a thermocouple in communication with said control valve, said thermocouple operable to determine the presence of the pilot light and to communicate with said control valve to terminate the flow of the flammable gas if the pilot light is absent.

13. The decorative display of claim 11, wherein said reservoir is filled with at least one of water, rock, coal, sand, gravel, glass, concrete, ceramic, metal, and brick.

14. The decorative display of claim 12, wherein the substance is water.

15. The decorative display of claim 11, wherein said water temperature electronics comprise:
- a first comparator operable to determine if a water temperature sensor is functioning; and
- a second comparator operable to determine if a temperature of the water is at or above a predetermined temperature.

16. The decorative display of claim 11, wherein said water level control electronics comprises:
- a voltage divider network in communication with a water level sensor disposed in the reservoir at a predetermined location; and
- a transistor in communication with the voltage divider network, the transistor operable to send a signal to the interlock electronics when said water level sensor detects an absence of water at the predetermined location.

17. The decorative display of claim 11, wherein said interlock electronics comprises a NOR gate.

18. The decorative display of claim 11, further comprising a circulation system operable to circulate the water into the reservoir.

19. The decorative display of claim 18, wherein said circulation system includes a pump to circulate the water, and further comprising a switch in electrical connection between the power source and said interlock system and between said power source and said pump, wherein if said pump is not receiving electrical power then said switch does not provide electrical power to said interlock system, and wherein, if said interlock system is not powered, said interlock system cannot open the control valve to allow the flammable gas to flow.

* * * * *